US010058752B2

(12) United States Patent
Fallon et al.

(10) Patent No.: US 10,058,752 B2
(45) **Date of Patent: *Aug. 28, 2018**

(54) DIVOT REPAIR TOOL

(71) Applicant: Sandgroup International Ltd., Hong Kong (HK)

(72) Inventors: Conor Fallon, Co Kildare (IE); Michel Zwart, Kwai Chung (HK)

(73) Assignee: Sandgroup International Ltd., Kwai Chung (HK)

( * ) Notice: Subject to any disclaimer, the term of this patent is extended or adjusted under 35 U.S.C. 154(b) by 0 days.

This patent is subject to a terminal disclaimer.

(21) Appl. No.: 15/432,579

(22) Filed: Feb. 14, 2017

(65) Prior Publication Data

US 2017/0151477 A1 Jun. 1, 2017

Related U.S. Application Data

(63) Continuation-in-part of application No. 15/066,618, filed on Mar. 10, 2016, now Pat. No. 9,925,437, which is a continuation of application No. 14/578,939, filed on Dec. 22, 2014, now Pat. No. 9,381,412.

(60) Provisional application No. 62/072,883, filed on Oct. 30, 2014.

(51) Int. Cl.

| | |
|---|---|
| ***A63B 57/50*** | (2015.01) |
| ***A63B 53/00*** | (2015.01) |
| ***A63B 53/14*** | (2015.01) |

(52) U.S. Cl.

CPC ..... *A63B 57/50* (2015.10); *A63B 53/007* (2013.01); *A63B 53/14* (2013.01); *A63B 2210/50* (2013.01)

(58) Field of Classification Search

CPC ..... A63B 57/50; A63B 53/14; A63B 53/007; A63B 57/60

USPC ..... 473/286

See application file for complete search history.

(56) References Cited

U.S. PATENT DOCUMENTS

| | | | | | |
|---|---|---|---|---|---|
| 3,049,182 | A | | 8/1962 | Pelow | |
| 3,061,270 | A | | 10/1962 | Lowe | |
| 3,415,518 | A | | 12/1968 | Root | |
| 3,539,017 | A | | 11/1970 | Johnson | |
| 3,763,515 | A | | 10/1973 | Voss | |
| 3,771,794 | A | * | 11/1973 | Crockett | A63B 57/50 172/378 |
| 4,799,684 | A | | 1/1989 | Rango | |
| 4,862,970 | A | * | 9/1989 | Hlavacek | A01B 1/24 172/378 |
| 4,892,314 | A | | 1/1990 | Rango | |
| 4,925,190 | A | | 5/1990 | Learned | |

(Continued)

FOREIGN PATENT DOCUMENTS

| | | |
|---|---|---|
| WO | 2011117425 | 9/2011 |

*Primary Examiner* — Steven Wong

(74) *Attorney, Agent, or Firm* — Jason T. Daniel, Esq.; Daniel Law Office, P.A.

(57) ABSTRACT

A divot repair tool includes a golf club grip having an internally located main body and prong assembly. The prong assembly including one or more prongs that extend and retract from the top end of the grip. One or more of the elongated prongs include a top end having a generally teardrop shape, and the tool further includes a knob for receiving a twisting motion to transition the tool between the extended and retracted position. The tool also includes a golf club having a shaft and a golf head.

11 Claims, 9 Drawing Sheets

(56) References Cited

U.S. PATENT DOCUMENTS 4,955,609 A * 9/1990 Kassen ..... A63B 57/50 473/286
4,984,790 A 1/1991 Dowdy et al.
5,004,240 A 4/1991 Tsukamoto
5,022,650 A 6/1991 Madock
5,110,123 A 5/1992 Larson
5,211,395 A 5/1993 Liao
5,226,647 A 7/1993 Notarmuzi
5,277,425 A 1/1994 Petriano, Sr.
5,305,999 A 4/1994 Tate
5,377,977 A * 1/1995 MacNeary ..... A01B 1/24 473/286
5,423,543 A 6/1995 Tarrant
5,449,169 A 9/1995 Hardin et al.
5,511,785 A * 4/1996 Rusin, Jr. ..... A01B 1/24 172/378
D375,815 S 11/1996 Kagasoff
5,706,900 A 1/1998 Liao
D391,318 S 2/1998 Shah et al.
5,759,111 A 6/1998 Clark
5,779,558 A 7/1998 Britton
D399,597 S 10/1998 Craven
D401,379 S 11/1998 Goldoftas
6,004,227 A 12/1999 Petersen
6,030,298 A 2/2000 Tate
6,162,137 A 2/2000 Jones et al.
6,050,905 A 4/2000 Tate
D424,151 S 5/2000 Miura
6,095,935 A 8/2000 Gooselaw et al.
6,190,265 B1 * 2/2001 Schmitt ..... A63B 47/02 294/19.2
6,223,829 B1 * 5/2001 Wiens ..... A01B 1/24 172/1
6,224,502 B1 5/2001 Warfield
6,244,356 B1 6/2001 Luna
6,413,174 B1 7/2002 Roberts
6,428,430 B1 8/2002 Chong
6,502,646 B2 1/2003 Wiens
6,565,458 B1 5/2003 Cameron
6,699,144 B1 3/2004 Kvitek
D488,527 S 4/2004 Ferschke
6,758,762 B2 7/2004 Markwood
6,837,807 B1 1/2005 Kerr
D513,632 S 1/2006 Sokolowski
6,991,557 B2 1/2006 Lisby, Jr.
D528,484 S * 9/2006 Schmidt ..... B60R 1/082 D12/187
D534,982 S 1/2007 Miller
7,250,006 B2 7/2007 McGonigle
D553,705 S 10/2007 Barouh
7,303,484 B2 12/2007 Bleske
7,351,158 B1 * 4/2008 Bronsveld ..... A63B 57/50 172/372
D578,680 S * 10/2008 Huang ..... D26/28
D582,734 S 12/2008 Murray et al.
7,527,563 B1 5/2009 Neu
7,621,819 B1 11/2009 Neu
7,713,136 B1 * 5/2010 Colucci ..... A63B 47/02 294/19.2
7,731,601 B2 6/2010 Penton
D633,999 S * 3/2011 Hideharu ..... D23/370
D713,287 S * 9/2014 Fildan ..... D11/200
D719,232 S 12/2014 Wallander
8,920,265 B1 12/2014 Jones
9,089,741 B2 * 7/2015 Kaluza ..... A63B 47/02
9,381,412 B2 * 7/2016 Fallon ..... A63B 57/0068
2002/0007955 A1 1/2002 Wiens
2002/0183138 A1 12/2002 Malcolm
2003/0104875 A1 5/2003 Markwood
2004/0219997 A1 11/2004 Champion
2005/0014572 A1 1/2005 Lisby, Jr.
2005/0070380 A1 3/2005 Miller et al.
2005/0202897 A1 9/2005 McGonigle
2006/0025230 A1 * 2/2006 Zeuch ..... A63B 57/50 473/286
2007/0049397 A1 3/2007 Bleske
2007/0060412 A1 3/2007 Penton
2007/0298900 A1 12/2007 Johnson
2008/0135444 A1 6/2008 Malcom
2008/0268985 A1 10/2008 Wiens et al.
2009/0098952 A1 4/2009 Leiber et al.
2010/0022330 A1 1/2010 Rourke et al.
2010/0099519 A1 4/2010 Leiber et al.
2011/0081994 A1 1/2011 Rourke
2015/0332837 A1 * 11/2015 Imanishi ..... H01F 3/14 336/221

* cited by examiner

DIVOT REPAIR TOOL

CROSS-REFERENCE TO RELATED APPLICATIONS

This application is a continuation-in-part of U.S. patent application Ser. No. 15/066,618, filed Mar. 10, 2016, which is a continuation of U.S. patent application Ser. No. 14/578,939, filed on Dec. 22, 2014, which claims priority to U.S. Application Ser. No. 62/072,883, filed on Oct. 30, 2014; and U.S. application Ser. No. 14/429,085, filed on Mar. 18, 2015. The contents of each of which are incorporated herein by reference.

TECHNICAL FIELD

The present invention relates generally to sporting goods, and more particularly to a device for use in the game of golf to repair divots.

BACKGROUND

The statements in this section merely provide background information related to the present disclosure and may not constitute prior art.

The game of golf is one of the most widely played sports activities in the world. Golf courses typically include either 9 or 18 holes, each comprising a teeing ground, a fairway area, one or more roughs (and other hazards), as well as a putting green where the hole is located.

Once the golf ball is on the green, a specialized golf club called a putter is used by the golfer. Putters are designed to strike a golf ball in a manner that keeps the ball on the ground, thereby ensuring greater accuracy. In this regard, it is important that the putting green be maintained with a smooth and uniform surface. However, putting greens can be damaged when golf balls are hit from a distance and drop onto the surface of the green. The landing of the ball can produce a depression/divot in the surface of the green, which can seriously affect the ability of the golfer to accurately putt.

There are several known tools for attempting to repair a divot. These tools typically include small handheld instruments having a plurality of shafts that are inserted into the turf at a precise angle, until the distal end of the tool is located beneath the divot. At that time, the user must manipulate the device to remove the divot and restore the turf to a smooth surface.

Although such devices work to correct the divots, they suffer from many drawbacks. First, because these devices are small, and designed to fit in the user's pocket, it is necessary for the user to bend to the ground in order to repair the divot. Such an activity is difficult for some users who suffer from physical ailments. Also, because the tools are so small, it is not uncommon for users to lose or simply forget to bring the tool to the green.

Accordingly, it would be beneficial to provide a divot repair tool that is integrated into the grip of a golf club, such as the putter, for example, in order to allow a user to quickly and easily repair divot marks without suffering from the drawbacks of the above noted devices.

SUMMARY OF THE INVENTION

The present invention is directed to a divot repair tool. One embodiment of the tool can include a golf club grip having an internally located main body and prong assembly.

The prong assembly including one or more prongs that can extend and retract from the top end of the golf club grip. One or more of the elongated prongs can include a distal end having a generally teardrop shape, and the tool can further include a knob for transition the tool between an extended and retracted position, upon receiving a twisting motion.

In another embodiment of the present invention, the bottom end of the main body can include a tapered bottom end. The bottom end can include a shape and size that is complementary to the shape and size of a golf club shaft, so as to engage the same and to be secured thereon.

Yet another embodiment of the present invention can include a golf club having the above described tool disposed along the top end of the club shaft.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
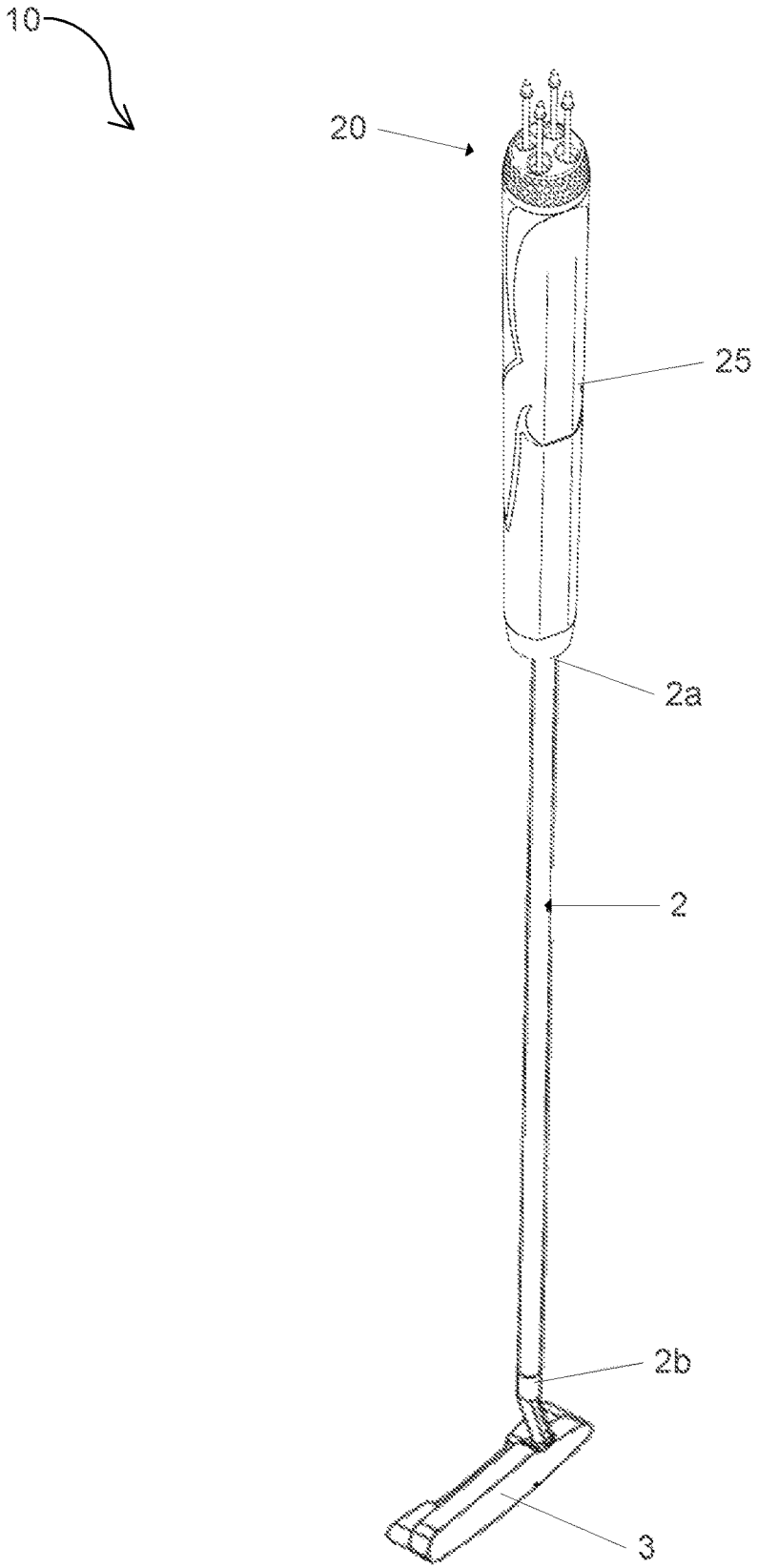
FIG. 1 is a perspective view of a golf club mounted divot repair tool that is useful for understanding the inventive concepts disclosed herein.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure.

Further, the terms and phrases used herein are not intended to be limiting but rather to provide an understandable description of the invention. Although described with respect to the game of golf, the inventive concepts disclosed herein are not to be construed as limiting to any particular sport or usage, as many other applications are contemplated.

As described throughout this document, the term "complementary shape," and "complementary dimension," shall be used to describe a shape and size of a component that is identical to, or substantially identical to the shape and size of another component.

As described herein, the term "indicia" can include any type of decorative elements such as colors, markings, words, shapes, symbols, logos, designs, types of materials, texturing of materials, patterns, images, lithographs, photographs and/or jewels such as rubies, diamonds, emeralds and the like. The indicia can be secured onto and/or into the device elements in accordance with known techniques so as to be flush with the surface, or can be raised/protruding outward from the surface so as to give a three dimensional effect.

FIGS. 1-9 illustrate various embodiments of a golf club 10 and a divot repair tool 20 that are useful for understanding the inventive concepts disclosed herein. Within the drawings, identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

FIG. 1 illustrates one embodiment of a golf club 10 that is useful for understanding the inventive concepts disclosed herein. As shown, the club can include, essentially, an elongated shaft 2 having an upper end 2*a* with an integrated divot repair tool 20, and a lower end 2*b* onto which a golf head 3 is secured.

Figure 2A:
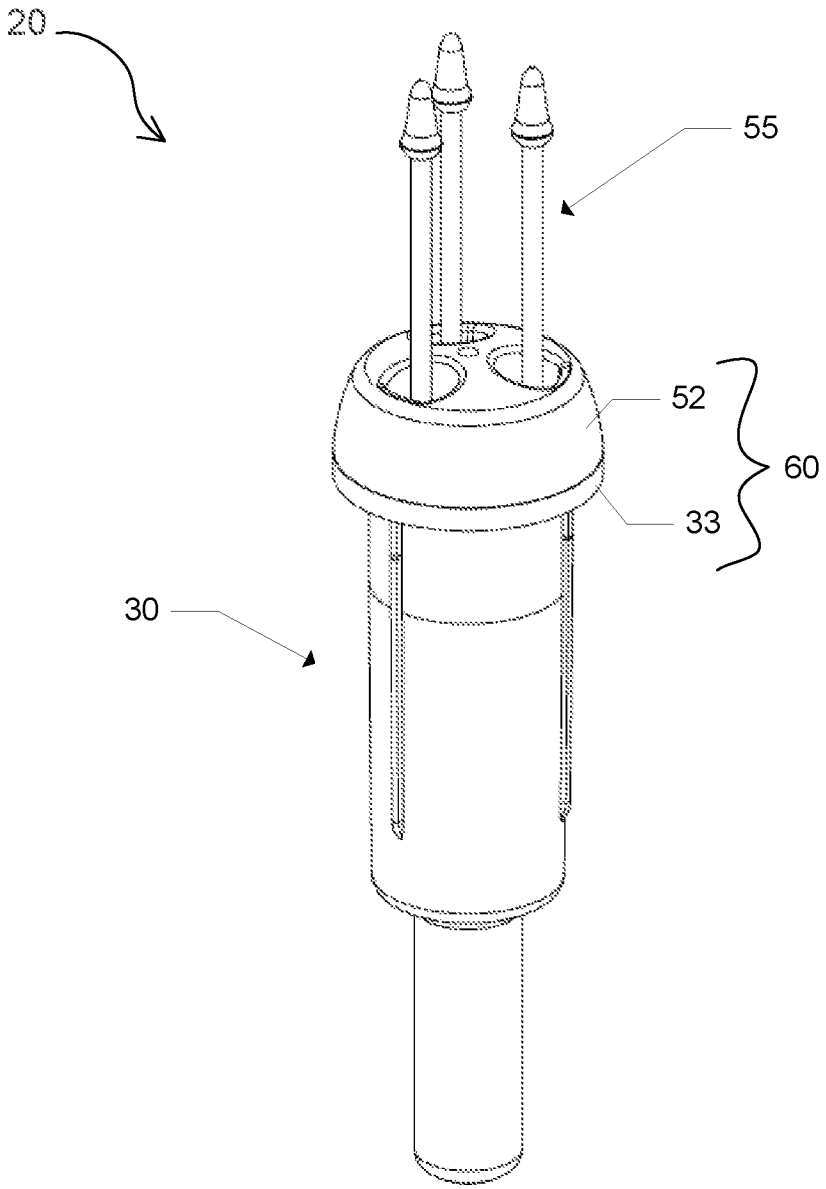
FIG. 2A perspective view of a divot repair tool, in accordance with one embodiment of the invention.
Figure 2B:
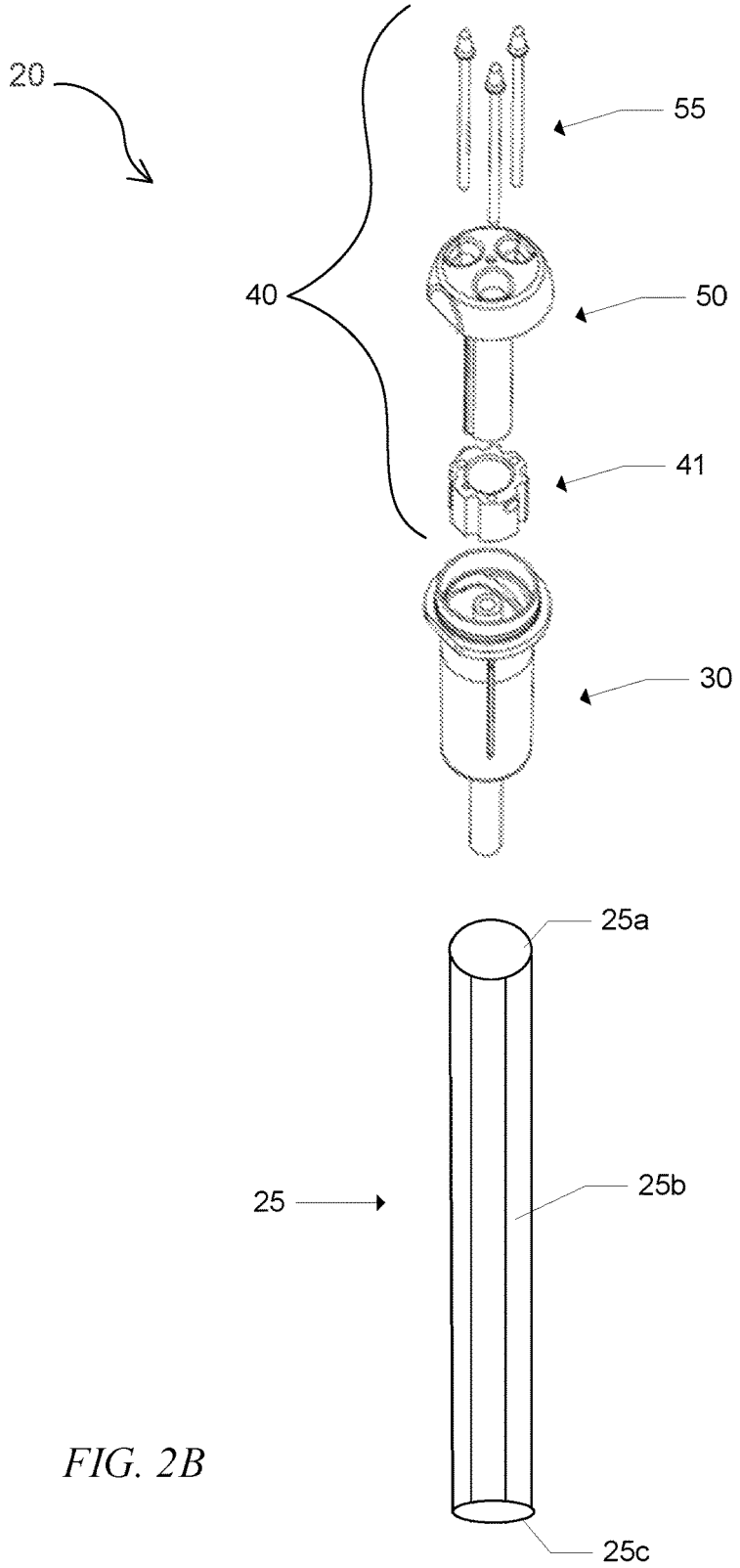
FIG. 2B is an exploded parts view of the divot repair tool, in accordance with one embodiment of the invention.

As shown in FIGS. 2A and 2B, the divot repair tool 20 can include a golf club grip 25, a main body 30, and a prong assembly 40.

In various embodiments, the tool 20 can be manufactured as an aftermarket component for use with any type or brand of golf clubs. Alternatively, the tool 20 can be integrated into the new construction of a golf club 10 so as to form an integral component thereof.

In either instance, the club grip 25 can house the remaining elements of the tool 20, and can also function as a traditional grip for a user when swinging the golf club. In one embodiment, the grip 25 can include an elongated, generally cylindrical member having a first end 25*a*, a middle portion 25*b*, and a shaft end 25*c*, that define a hollow interior space. In the preferred embodiment, the grip can be constructed or molded from a plastic or rubber compound having an internal circumference/diameter along the shaft end of the grip that is slightly smaller than the external diameter of the upper end of the golf club shaft 2*a* onto which the grip is to be installed.

Figure 6:
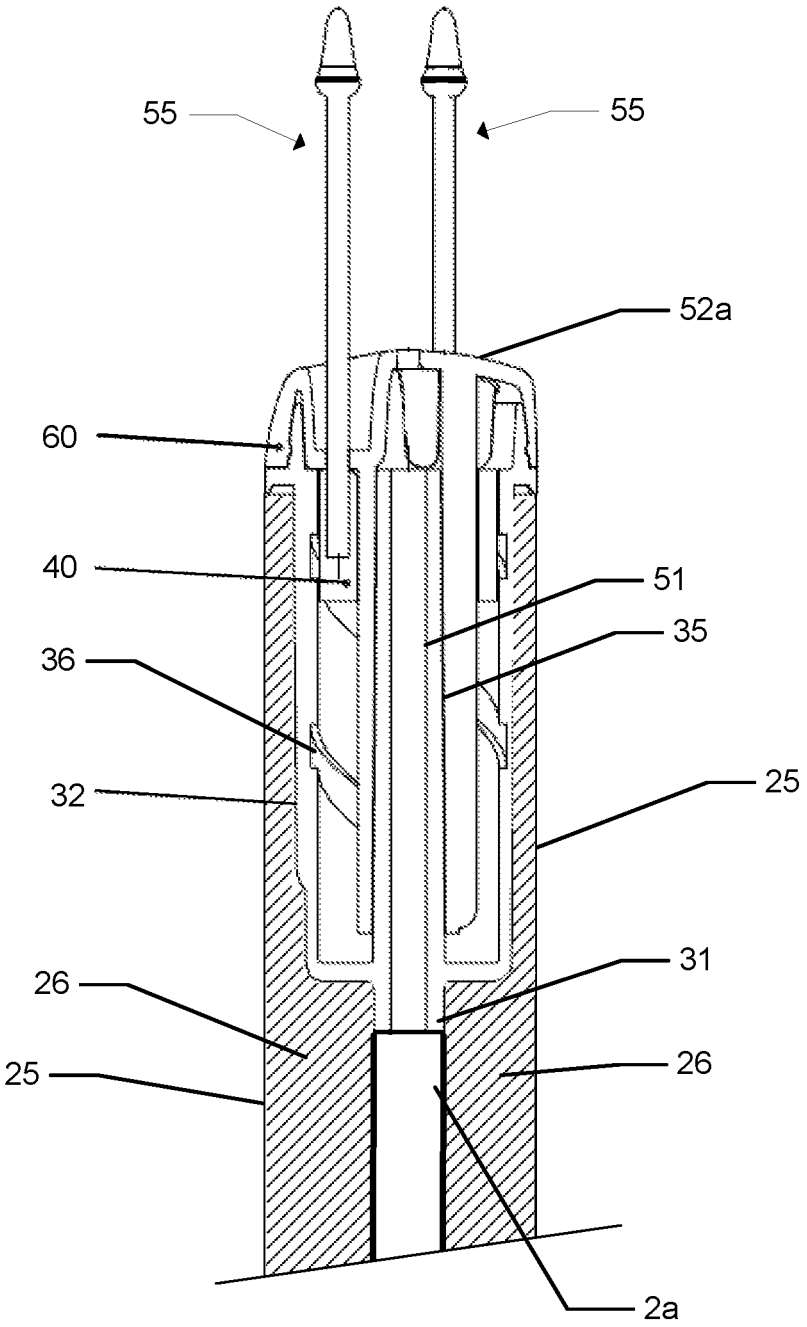
FIG. 6 is a cross sectional view of the divot repair tool, in accordance with one embodiment of the invention.

In various embodiments, padding 26 such as foam or rubber, for example may be positioned within the interior portion of the grip (see FIG. 6). Such material can function to enlarge the outer surface area of the grip, and to allow the grip to seamlessly transition from the small diameter necessary to accommodate the club shaft, to the larger diameter of the tool body 30. Of course, the grip 25 is not to be construed as limiting to the above configuration, as any number of different shapes, sizes, indicia and/or construction materials are contemplated, so as to allow the device 20 to function with golf clubs of any size, type material and/or manufacturer.

Figure 3:
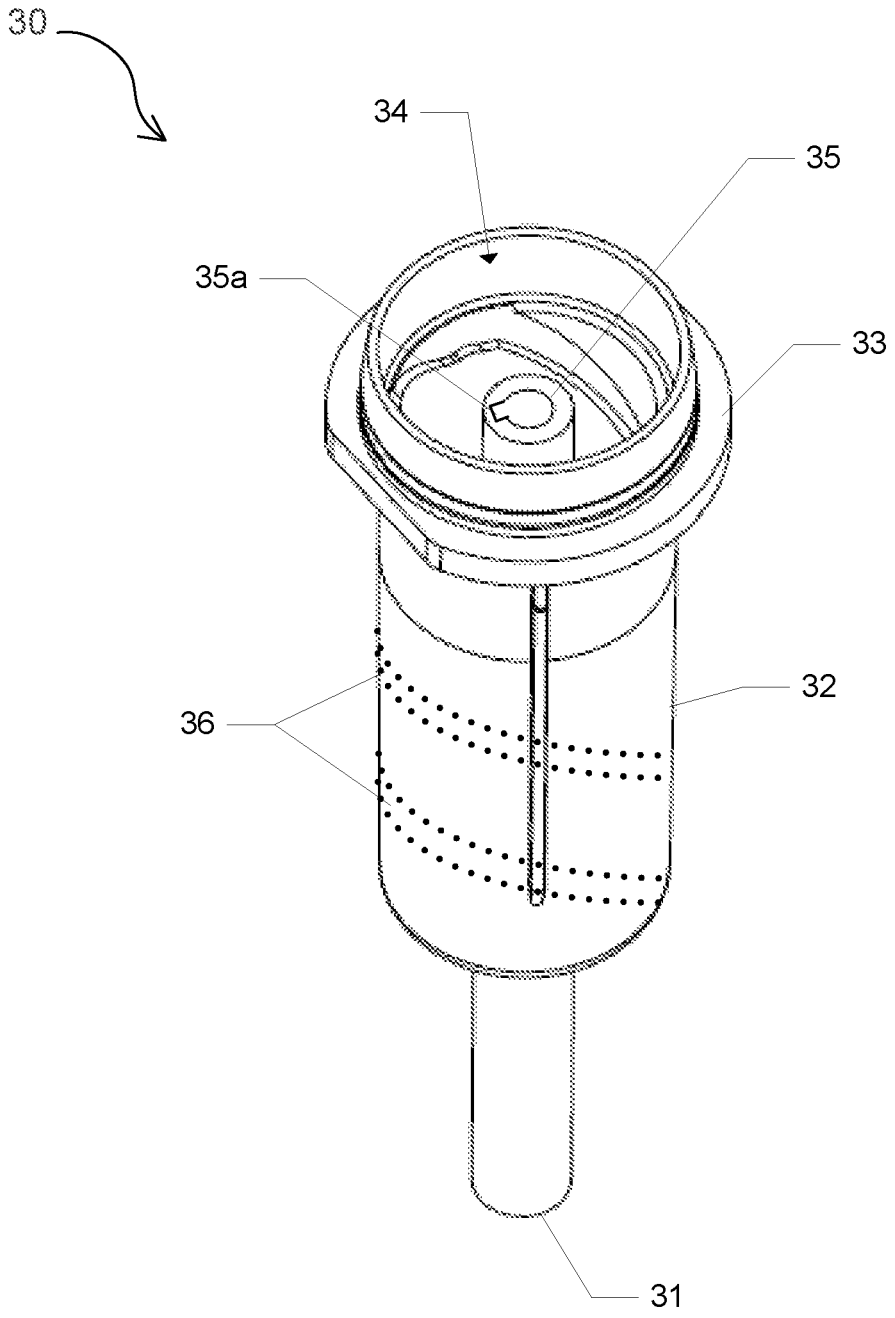
FIG. 3 is a perspective view of the main body of the divot repair tool, in accordance with one embodiment of the invention.

FIG. 3 illustrates one embodiment of the main body 30. As shown, the main body can include a tapered bottom end 31, a central body portion 32 having a lip 33 that surrounds an opening 34 along the top end thereof. As shown, a hollow central shaft 35 is positioned within the central body portion of the main body, and a plurality of spiral grooves 36 are located along the inside surface of the central portion. The tapered bottom end 31 includes a shape and dimension that is suitable for engaging the open top end of the golf club shaft 2*a*. In the preferred embodiment, the bottom end 31 can be inserted within the open top end of the club shaft, however other embodiments are contemplated wherein the bottom end 31 includes an opening that receives the top of the shaft 2*a*. In either instance, when so positioned, the main body is securely positioned onto the end of the shaft 2*a*, and the central portion 32 extends upward therefrom. Likewise, the grip 25 covers the upper end of the club 2*a*, and extends along the entirety of the main body to a location adjacent to the lip 33 (See FIG. 6).

Figure 4:
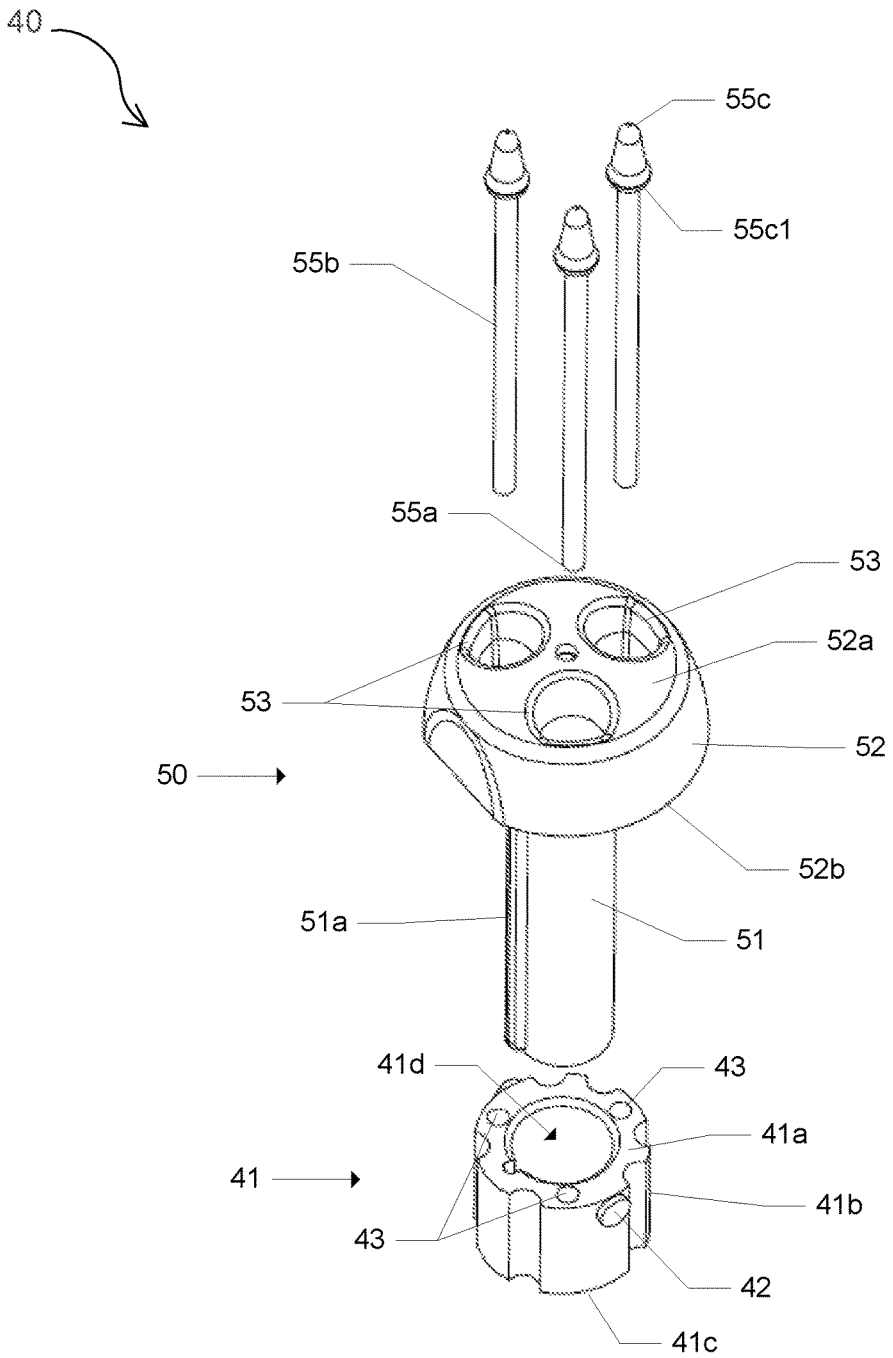
FIG. 4 is an exploded parts view of the prong assembly of the divot repair tool, in accordance with one embodiment of the invention.

FIG. 4 illustrates one embodiment of the sliding prong assembly 40 that includes a generally circular prong holder 41, a guide 50 and a plurality of elongated prongs 55. As shown, the prong holder 41 can include a generally circular member having a top end 41*a*, a middle section 41*b*, a bottom end 41*c* and a hollow central portion 41*d*. One or more protrusions 42 can be positioned along the middle section of the main body, and a plurality of apertures 43 can be positioned along the top end 41*a*.

The guide 50 can include an elongated guide shaft 51 having a head portion 52 with a plurality of prong openings 53 extending therethrough. The head portion 52 can preferably include a larger diameter than the shaft, and can include a top end 52*a* and a bottom end 52*b*. The guide shaft 51 can include a size that is less than the size of the central portion 41*d* of the prong holder 40, and that is complementary to the size of the hollow central shaft 35. As shown, the guide shaft can include an elongated protrusion 51*a* along a length thereof, which is positionable within a slotted opening 35*a* of the hollow central shaft 35. Such a feature allows the guide to move linearly within the central shaft 35, but prevents rotation of the same.

The device can include any number of elongated prongs. Each of the elongated prongs 55 can include a bottom end 55*a*, a middle section 55*b* and a distal end 55*c*. As shown, the teardrop-shaped tip 55*c* can include a pointed first end that is configured to penetrate an organic material during a downward motion, and a generally circular second end 55*c*1 comprising a broad proximal portion that is in communication with the middle section 55*b*, wherein an outside diameter of the broad proximal portion is greater than an outside diameter of the middle section and functions to engage and apply an upward force to the organic material during an upward motion. The teardrop-shaped tip also includes a substantially conically tapered middle section that extends between the pointed first end and the second end. In the preferred embodiment, each of the elongated prongs can be constructed from a sturdy and impact resistant material such as steel, for example, and the distal end can include a pointed, generally teardrop-shape. The use of a teardrop-shaped is particularly advantageous, as this feature reduces damage to the turf, as opposed to other types of divot repair tools. In this regard, when the prong is inserted into the ground, the pointed end of the prong can gently separate the root structure. Then, when the user lifts the prongs straight up to remove the divot, the broad portion of the teardrop 55*c*1 engages a larger portion of the ground and imparts a greater lifting force onto the root structure until the same becomes flat. At that point, by continuing to pull upward the root structure gently separates and allows removal of the tool. Of course, other embodiments are contemplated wherein other shapes and construction materials such as various metals, plastics and/or composites are utilized.

Figure 5:
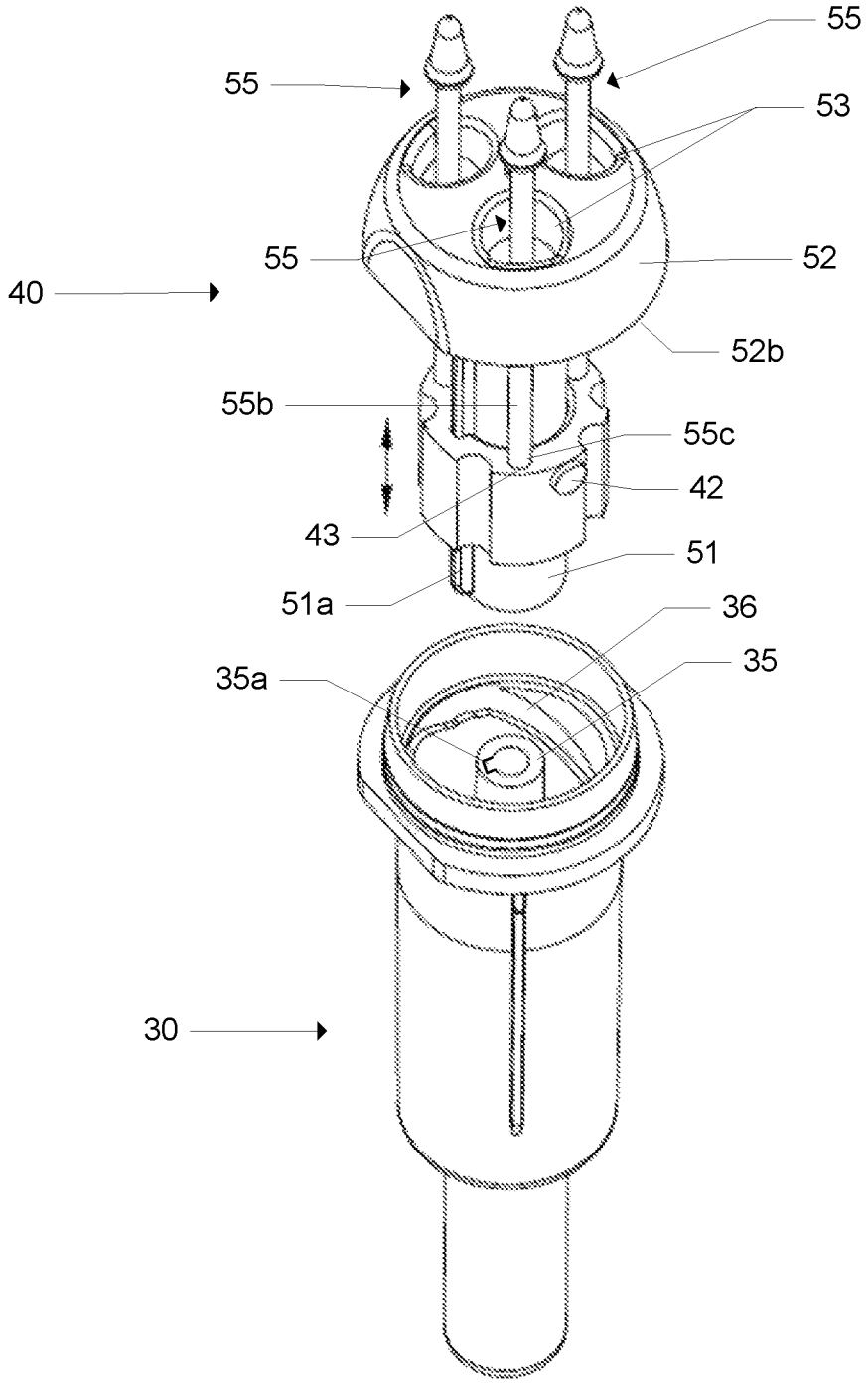
FIG. 5 is a perspective view of the prong assembly and the main body of the divot repair tool, in accordance with one embodiment of the invention.

As shown in FIGS. 5 and 6, each of the prongs 55 can be positioned within an opening 53 so that the middle sections 55*b* are generally parallel with the guide shaft 51. At this time, the guide shaft 51 can be positioned within the hollow central portion 41*d* of the prong holder 40, and the bottom end of each prong 55*a* can be secured within the apertures 43. When so assembled, the entire assembly 40 can be positioned within the main body 30. In particular, the elongated protrusion 51*a* of the guide shaft 51 can be aligned with the slotted opening 35*a* of the hollow central shaft 35 and slid downward. At this time, the hollow central shaft 35 can be positioned within the hollow central portion 41*d* of the prong holder 40, the one or more protrusions 42 can engage the spiral grooves 36 within the main body, and the bottom end of the head 52*b* can be positioned along the lip 33 of the main body. When the head and lip are secured together, these components form a knob 60.

Figure 7:
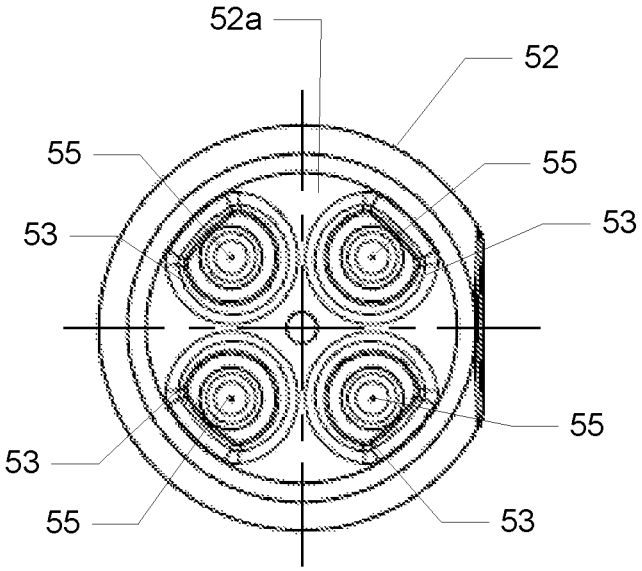
FIG. 7 is a top view of the divot repair too, in accordance with one embodiment of the invention.

Although described above as utilizing a particular arrangement of components to transition the tool between an extended and retracted state, those of skill in the art will recognize that many other mechanisms can be employed to perform the described functionality without undue experimentation. To this end, the device 20 can include or comprise any number of different components that are capable of transitioning the prongs between the extended and retracted position. Moreover, although illustrated above with respect to three prongs, other embodiments of the device are contemplated having any number of different prongs. To this end, FIG. 7 illustrates another embodiment wherein the device includes four individual prongs 55.

Figure 9:
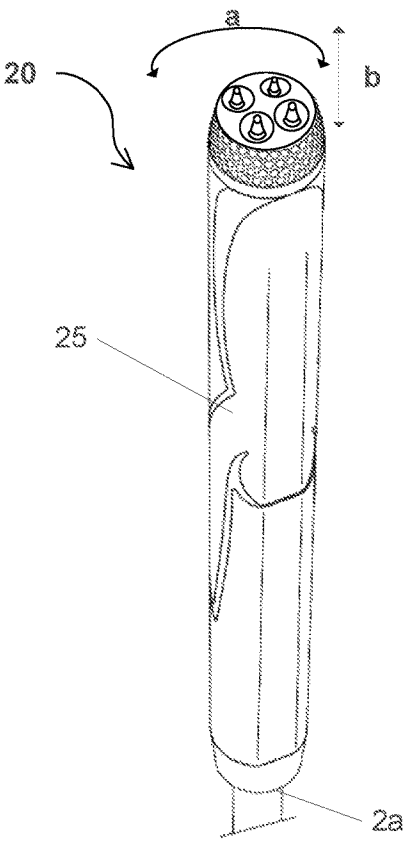
FIG. 9 is a perspective view of the divot repair tool in a retracted position, in accordance with one embodiment of the invention.
Figure 8:
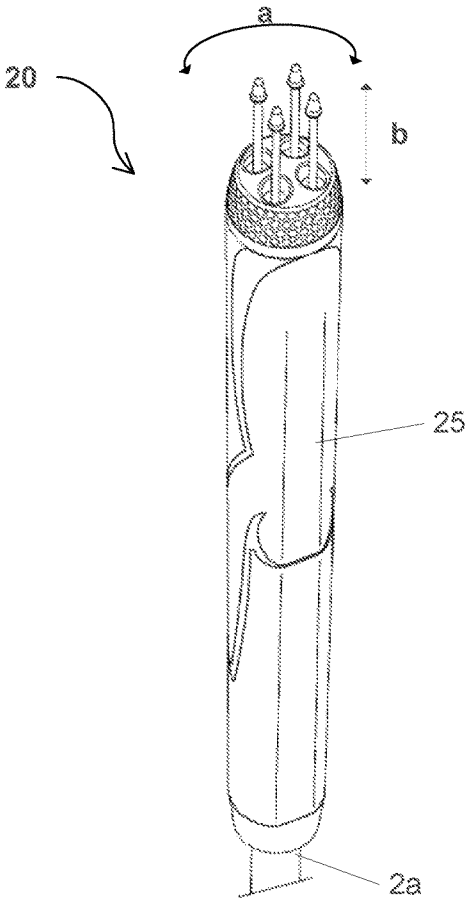
FIG. 8 is a perspective view of the divot repair tool in an extended position, in accordance with one embodiment of the invention.

FIGS. 8 and 9 illustrate one embodiment of the tool 20 in operation. As shown, when a twisting motion (see arrow a) is applied to the knob 60, the prong holder 40 also twists, causing the protrusions 42 to travel along the spiral grooves 36 and to move linearly up and down within the main body. This linear movement is also performed by the prongs 55, which function to extend and retract, respectively, with the motion of the holder 40 (see arrow b).

As described herein, each element of the divot repair tool can be constructed from any number of different materials such as plastic, steel or aluminum, for example, which are durable and resistant to adverse weather conditions. Additionally, one or more elements of the device can be secured together utilizing any number of known attachment means such as, for example, screws, glue, compression fittings and welds, among others. Moreover, although the above embodiments have been described as including separate individual elements, the inventive concepts disclosed herein are not so limiting. To this end, one of skill in the art will recognize that one or more individual elements of the device may be formed together as one continuous element, either through manufacturing processes, such as welding, casting, or molding, or through the use of a singular piece of material milled or machined with the aforementioned components forming identifiable sections thereof.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A divot repair tool, comprising:

a golf club grip having a bottom end, an open top end, and a hollow central portion;

a main body that is positionable within the golf club grip, said main body including a bottom end, an open top end, and a hollow interior space; and a prong assembly that is disposed within the interior space of the main body, said prong assembly including a guide, and a plurality of discrete elongated prongs, each having a proximal end and a distal end;

wherein each of the plurality of elongated prongs are displaceable relative to the club grip so as to transition between an extended position and a retracted position, and wherein the distal end of each of the plurality of elongated prongs includes a teardrop-shaped tip comprising a pointed distal end configured to penetrate an organic material during a downward motion;

a generally circular proximal end comprising a broad proximal portion that is in communication with an elongated central body section, wherein an outside diameter of the broad proximal portion is greater than an outside diameter of the elongated central body section to engage and apply an upward force to the organic material during an upward motion, and a substantially conically tapered middle section that extends between the pointed distal end and the proximal end.

2. The tool of claim 1, wherein the bottom end of the main body includes a tapered shape that is configured to engage a shaft opening of a golf club.

3. The tool of claim 1, wherein the bottom end of the club grip includes a circumference that is complementary to a circumference of a golf club shaft.

4. The tool of claim 1, further comprising:

a knob that is configured to transition each of the plurality of elongated prongs between the extended and retracted positions.

5. The tool of claim 1, wherein the distal end of each of the elongated prongs are located within the central portion of the golf club grip when the device is in the retracted position.

6. The tool of claim 1, wherein the plurality of elongated prongs comprises:

three elongated prongs, each having a teardrop-shaped tip along the distal end.

7. The tool of claim 1, wherein the plurality of elongated prongs comprises:

four elongated prongs, each having a teardrop-shaped tip along the distal end.

8. A golf club, comprising:

an elongated shaft having an upper end and a lower end;

a golf head that is secured along the lower end of the elongated shaft;

a golf club grip that is disposed along the upper end of the elongated shaft, said grip including a bottom end, an open top end, and a hollow central portion;

a main body having a bottom end that is in communication with the upper end of the elongated shaft, an open top end, and a hollow interior space, said main body being secured within the golf club grip; and a prong assembly that is disposed within the interior space of the main body, said prong assembly including a guide, and a plurality of discrete elongated prongs, each having a proximal end and a distal end;

wherein each of the plurality of elongated prongs are displaceable relative to the club grip so as to transition between an extended position and a retracted position, and wherein the distal end of at least one of the plurality of elongated prongs includes a teardrop-shaped tip comprising a pointed distal end configured to penetrate an organic material during a downward motion;

a generally circular proximal end comprising a broad proximal portion that is in communication with an elongated central body section, wherein an outside diameter of the broad proximal portion is greater than an outside diameter of the elongated central body section to engage and apply an upward force to the organic material during an upward motion, and a substantially conically tapered middle section that extends between the pointed distal end and the proximal end.

9. The tool of claim 1, further comprising:

a central shaft that is fixedly positioned within the hollow interior space of the main body;

a plurality of spiral grooves that are positioned within the hollow interior space of the main body along an interior wall surrounding the central shaft;

a prong holder having a central aperture that is in communication with the guide, and at least one protrusion that is positioned within one of the plurality of spiral grooves; and a knob that is in communication with the prong assembly and being configured to transition the plurality of elongated prongs between the extended and retracted positions.

10. The tool of claim 8, further comprising:

a central shaft that is fixedly positioned within the hollow interior space of the main body;

a plurality of spiral grooves that are positioned within the hollow interior space of the main body along an interior wall surrounding the central shaft;

a prong holder having a central aperture that is in communication with the guide, and at least one protrusion that is positioned within one of the plurality of spiral grooves; and a knob that is in communication with the prong assembly and being configured to transition the plurality of elongated prongs between the extended and retracted positions.

11. A divot repair tool, comprising:

a golf club grip having a bottom end, an open top end, and a hollow central portion;

a main body that is positionable within the golf club grip, said main body including a bottom end, an open top end, and a hollow interior space; and a prong assembly that is disposed within the interior space of the main body, said prong assembly including a guide, and a plurality of discrete elongated prongs, each having a proximal end and a distal end;

a central shaft that is fixedly positioned within the hollow interior space of the main body;

a plurality of spiral grooves that are positioned within the hollow interior space of the main body along an interior wall surrounding the central shaft;

a prong holder having a central aperture that is in communication with the guide, and at least one protrusion that is positioned within one of the plurality of spiral grooves; and a knob that is in communication with the prong assembly and being configured to transition the plurality of elongated prongs between the extended and retracted positions, wherein each of the plurality of elongated prongs are displaceable relative to the club grip so as to transition between an extended position and a retracted position, and wherein the distal end of at least one of the plurality of elongated prongs includes a teardrop-shaped tip.

* * * * *